US005163193A

United States Patent [19]

Whitmore

[11] Patent Number: 5,163,193

[45] Date of Patent: Nov. 17, 1992

[54] 4-POST SPINAL SYSTEM WITH VACUUM LOCK

[76] Inventor: Henry B. Whitmore, Rte. 5, Box 369, San Antonio, Tex. 78221

[21] Appl. No.: 775,007

[22] Filed: Oct. 11, 1991

[51] Int. Cl.[5] ..... A61G 13/00

[52] U.S. Cl. ..... 5/600; 5/30; 5/652

[58] Field of Search ..... 5/600, 612, 621, 630, 5/632, 652, 657; 602/22, 33; 606/237-242; 248/118, 163.1, 362, 671

[56] References Cited

U.S. PATENT DOCUMENTS

| | | | |
|---|---|---|---|
| 1,984,520 | 12/1934 | Curtis | 5/630 X |
| 3,028,131 | 4/1962 | Beck et al. | 248/362 X |
| 3,910,620 | 10/1975 | Sperry | 248/362 X |
| 4,391,438 | 7/1983 | Heffington, Jr. | 5/632 X |
| 4,398,707 | 8/1983 | Cloward | 5/632 |
| 4,840,362 | 6/1989 | Bremer et al. | 6/632 |
| 4,908,892 | 3/1990 | Michelson | 5/632 |
| 4,951,911 | 8/1990 | Zatopeck et al. | 248/362 |
| 4,969,222 | 11/1990 | Serola | 5/652 X |

*Primary Examiner*—Michael F. Trettel
*Attorney, Agent, or Firm*—Paul H. Gallagher

[57] ABSTRACT

Four post units in a positional pattern on which the patient lies, in a surgery operation. The post units are supported on a table, and have recesses in their under surface forming vacuum chambers with the table top. Hoses lead from the vacuum chambers to a vacuum source, and valve means individually control the hoses. The post units are thus locked in place by vacuum, and each can be released individually to enable it to be adjustably moved on the table top to enable better positioning for engagement by the patient.

15 Claims, 2 Drawing Sheets

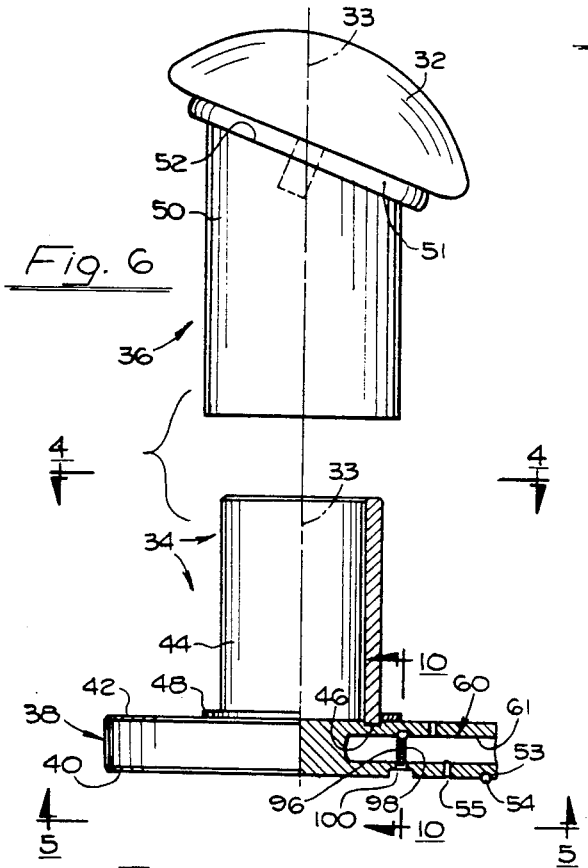
Fig. 6
Fig. 4
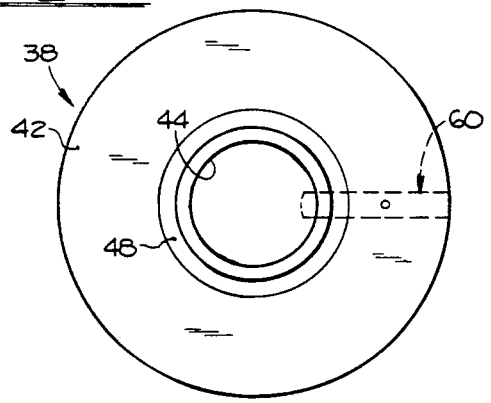
Fig. 5
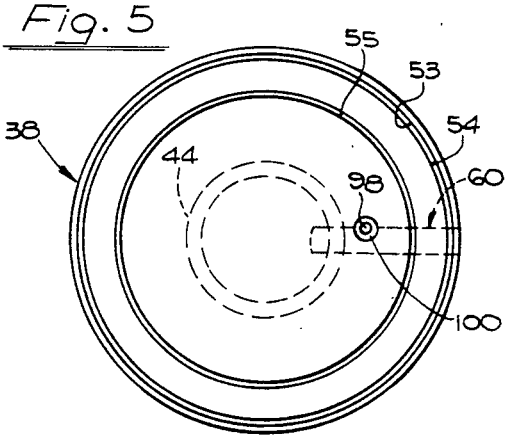
Fig. 8
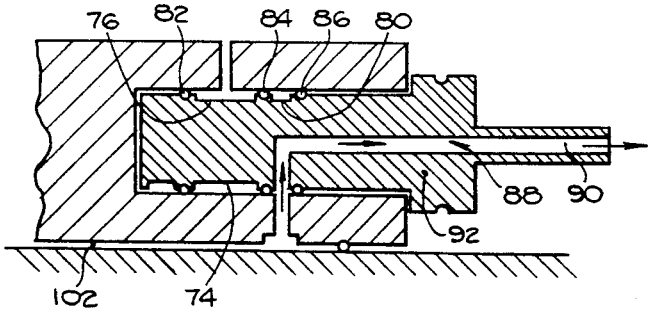
Fig. 7
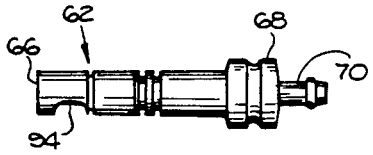
Fig. 9
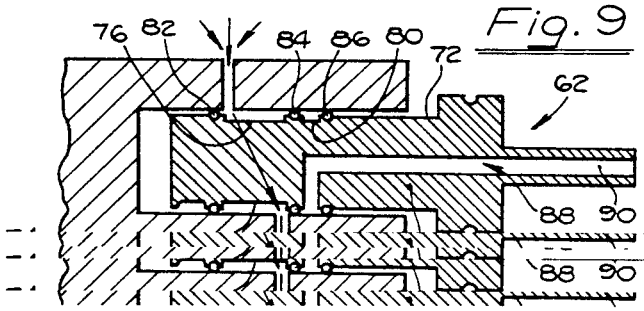
Fig. 10
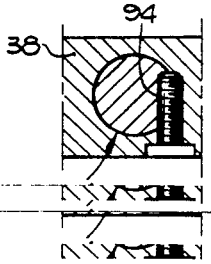

4-POST SPINAL SYSTEM WITH VACUUM LOCK

FIELD OF THE INVENTION

The invention resides in the field of equipment for supporting a patient in a spinal surgery operation. The apparatus of the invention includes four posts arranged in a certain pattern, for supporting the patient, on whom a spinal operation is to be performed. The patient lies face down on the posts, the posts having cushions, the posts being positioned for engagement by the body of the patient at corresponding and appropriate points, e.g., at the sides and upper and lower.

It is very important, and indeed critical, that the posts be movable for proper positioning for properly supporting the patient and for his comfort.

Heretofore, serious problems have been encountered, in so moving and re-positioning the posts.

SUMMARY OF THE INVENTION

A principal and broad object of the invention is to provide apparatus overcoming the difficulties indicated above.

A more specific object is to provide apparatus of the foregoing character that includes novel vacuum securing means for securing the posts in position and enabling their quick and easy adjusting movements.

Another object is to provide apparatus of the foregoing character wherein the posts can be moved in infinitesimal increments, and are securely held, eliminating fear of accidental movement.

BRIEF OF DESCRIPTION OF THE SEVERAL VIEWS OF THE DRAWINGS

FIG. 4 is a top view taken at line 4—4 of FIG. 6, showing a single post unit.

FIG. 5 is a bottom view taken at line 5—5 of FIG. 6, also a single post unit.

FIG. 6 is a side view of the bottom portion of a single post unit, partially in section.

FIG. 7 is a face view of the valve stem of the valve means.

FIG. 8 is a large scale view oriented according to the lower right hand corner of FIG. 6 showing the valve stem in its outer release position.

DETAILED DESCRIPTION

The essence of the invention resides in means for securing a plurality of posts for supporting a patient, and the concept is embodied in each of the individual posts, and hence the scope of the invention includes both the plurality of posts, and a single post.

The members or components referred to above as posts, are so called in the profession, but because in the present disclosure, those members include other elements, they are referred to herein as post units or post assemblies.

Figure 1:
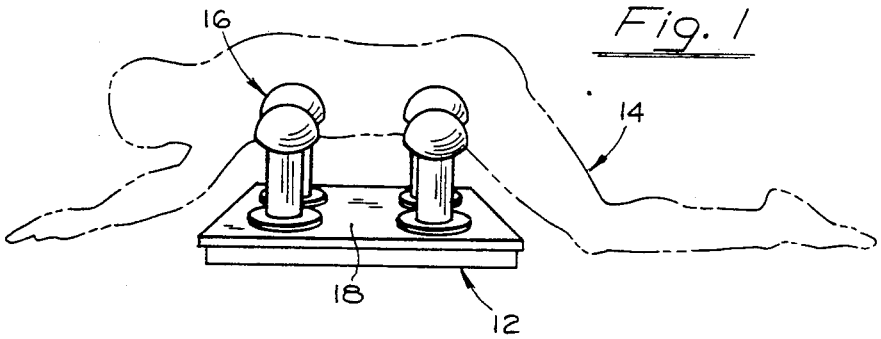
FIG. 1 is a perspective view of the apparatus of the invention, including four posts or post units for use in surgery, and indicating a patient supported thereon.
Figure 2:
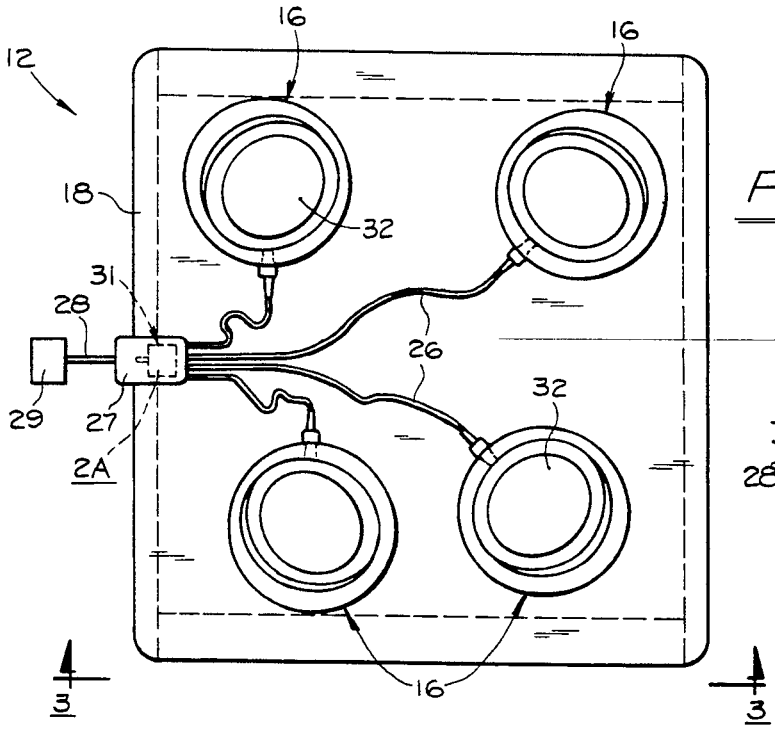
FIG. 2 is a top view of the device of FIG. 1.
Figure 3:
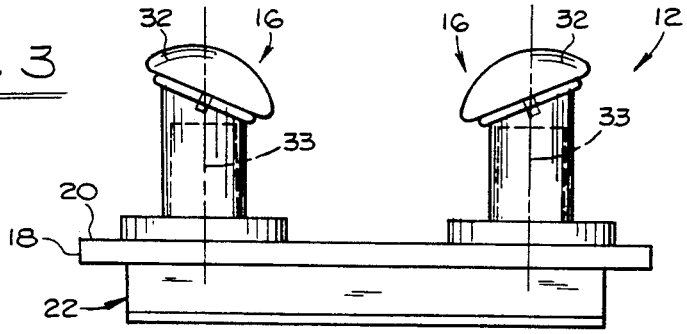
FIG. 3 is a side view, taken at line 3—3 of FIG. 2.

Referring first to FIGS. 1-3, the apparatus adapts to surgery on a patient, and is indicated in its entirety at 12, and the patient at 14. Preferably, the apparatus is made of plastic material, except certain minor elements such as gaskets. The surgery apparatus 12 includes four post units 16 mounted on a table top member 18, this table top member being utilized for providing a unified kit or piece of equipment, with plurality of post units, that can be handled readily as a unit, in a surgery operation. The table top member provides a smooth top surface 20 for cooperation with the post units, in the vacuum securement feature, and thus assuring such a smooth surface in a practical situation.

The table top member 18 is of any suitable size, and may have a bottom element 22 for practical convenience. The post units 16 rest directly on the table top member. It will be understood that the post units may be placed on another table, instead, if desired.

The overall complete piece of equipment 12 also includes a plurality of vacuum tubes or lines 26 connecting individually with the post units and leading to a vacuum manifold 27 and from the latter a common vacuum tube 28 leading to a source of a vacuum 29. The tubes 26, 27 may be flexible, and the vacuum manifold and the vacuum source may be of any known type, and detailed description thereof is believed not necessary herein.

The vacuum system includes a valve means 30 including a check valve 31 in each of the tubes 26, yielding in direction from the tubes to the manifold 27. The specific function of this valve means will be described hereinbelow.

The post units 16 are placed on the table top member at locations according to their function in supporting the patient as indicated in FIG. 1, such locations being shown in FIG. 2. Each of the post units includes a cushion pad 32 which is positioned at an angle to the vertical (FIG. 3) and is rotatable about a vertical axis 33 through the post unit, for better fitting the body of the patient according to the size and shape of the latter.

Referring to one of the post units in detail, attention is directed first to FIG. 4-6. The post unit includes a lower part 34 and an upper part 36. The lower part 34 includes a base 38 having a lower surface 40 and an upper surface 42. This base may be a simple round plate, but having certain features referred to hereinbelow. Mounted on and secured to the base is a cylinder element 44 (preferably tubular). It may be secured by fitting it in an annular groove 46, and it is surrounded by a flat resilient washer 48, such as of rubber.

The upper part 36, includes a main portion 50 of cylindrical tubular form, forming a sleeve telescoped over the element 34 and resting on the resilient washer 48, the sleeve 50 being slidable and rotatable on the element 44, but without undue play.

The cushion pad 32 (FIG. 3) is mounted on a plate 51 which is secured to the upper surface 52 of the sleeve at an angle to the vertical, for presenting the face of the cushion pad in an appropriate direction for engaging the patient (FIG. 1) according to the contour of the patient. The bottom post element 44 and the upper part 36 in themselves are of known construction, but it is pointed out that the essence of the invention is the provision of the base 38 for those elements, and the vacuum securing means for the device.

The under surface 40 of the base 38 is provided with an outer annular groove 53 adjacent the periphery of the base, and another annular groove 55 spaced inwardly from the groove 53. A sealing O-ring 54, as of rubber or appropriate resilient material, is fitted in the groove 53, for sealing the post unit on the table top member, as referred to again hereinbelow.

Figure 9:
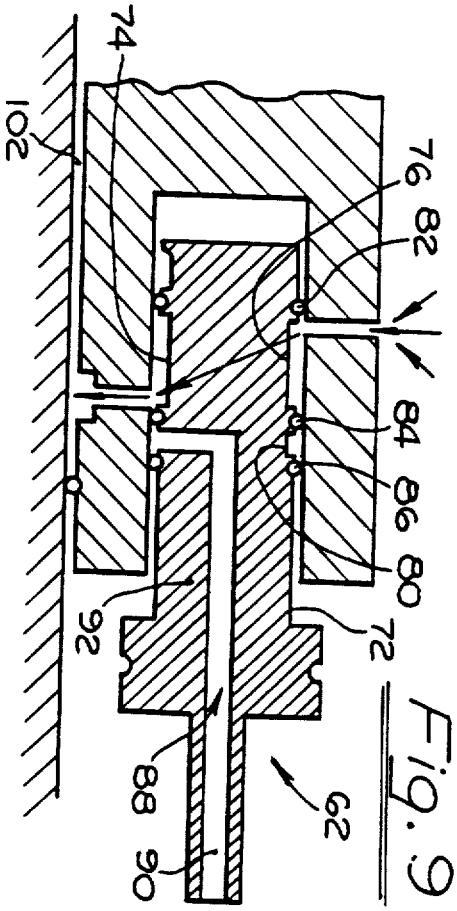
FIG. 9 is a view similar to FIG. 8 but showing the valve stem in its inner securing position.

Incorporated in the base 38 is a vacuum control valve 60 which may be any of various kinds operable for performing the desired result. A preferred form includes a radial bore 61 (FIG. 6) and a valve stem or plug 62 (FIG. 7). FIGS. 8 and 9 show the valve stem in the bore. A longitudinal axis 63 of these parts is shown. The valve stem is slidable in the bore between an inner securing position (FIG. 8) and an outer release position (FIG. 9). A vent port 64 leads from the bore 61 to the exterior, and a vacuum port 65 leads from the bore downwardly and communicates with the annular groove 55.

The valve stem 62 includes an inner main body portion 66, a pull knob 68 adjacent an outer end, and a hose nipple 70 at its outer end. The valve body is generally cylindrical, having a main outer dimension surface 72. It is provided with a reduced portion 74 adjacent to but spaced from its inner end, forming an annular groove 76 which is relatively long axially. It is provided with another reduced portion 78 relatively short axially, forming an annular groove 80.

The body of the valve stem is provided with annular grooves for receiving O rings 82, 84, 86. The O rings 82, 84 isolate the groove 80 and the O rings 84, 86 isolate the groove 76.

The valve stem 62 includes a passage 88 having a main axial portion 90 and a radial portion 92 communicating with the groove 80. The axial portion 90 extends out through the outer end of the valve stem and communicates with the corresponding one of the vacuum tubes 26, and thus the vacuum manifold 28, vacuum tube 30, and main vacuum source 31.

The valve stem 62 is provided with a cutout or recess 94 (FIG. 7, 10) inwardly of the 0 ring 86. In the base 38 of the post unit is a screw 96 (FIGS. 6, 10) utilized for limiting the axial slighting movement of the valve stem. This screw 96 is driven in a threaded hole 98 in the base, penetrating through the bore 66 and thereby extending into the recess 94. The bore 96 has a counter bore 100 for receiving the screw head thereby leaving the under surface of the base clear and smooth. Upon axial sliding of the valve stem, as referred to below, its sliding movements are limited by engagement of axially opposite edge surfaces of the groove 76 with the screw.

In the operation of a post unit of the apparatus, the valve stem 62 is moved, e.g., to its inner securing position (FIG. 8), and in such position the O rings 82, 84 isolate the vacuum port 65 and the valve passage 90 communicates with the vacuum port 65 and thereby with the annular groove 55. The O ring 56 in the under surface of the base engages the table top surface and forms a sealed space 102 under the base, and between it and the table top surface. The vacuum is transmitted from the source through the passage 90, vacuum port 65 and the space 102 and as a result, atmospheric pressure is imposed on the base and seals the base securely on the table top.

The valve stem is easily movable manually, by gripping the pull knob 68 and merely sliding it. Upon sliding it to the inner position (FIG. 8), the vacuum is established immediately, and from a practical standpoint it may be considered instantaneously. The volume of the space 102 is very small, and upon vacuum being imposed there, the removal of the smallest increment of air establishes a vacuum which will hold the base, and immediately in the same step vacuum in that space continues to a great value. In a practical example, the O ring 54 in the underside of the base may be in the neighborhood of 6½" in diameter, and the atmospheric pressure imposed on the base, because of this dimension, is immense.

Upon pulling the valve stem to its outer release position (FIG. 9), the annular groove 76 communicates with both ports 64, 65, and the O rings 84, 86 isolate those ports, and communication is established between those ports through the groove 76 from the space 102 to the exterior.

In each of these positions, the action of vacuum effect, or release thereof, is substantially instantaneous. In this case also because of the small volume of the space 102 under the base, the vacuum in the space 102 is destroyed quickly, and it is pointed out that the volume of this space need not be great, but can be of the smallest dimensions, i.e., height. As an example of dimensions utilized in a practical device, the O ring 56 may be on the order of ⅛" in cross-sectional dimension, and thus the maximum vertical dimension of the space 102 would be in the neighborhood of 1/16", or less than that due to the weight of the device.

The post units 16, as mentioned above, are all independent of each other, and they are individually movable on the table top, having no connection with each other, and thus individually operable and controllable, The post units are movable laterally in any direction and from a practical standpoint in a surgery operation, they can be moved toward or from the patient, or sideways, to fit the patient better, or even to aid in his comfort. Since post units are movable individually they are of course movable in relation to each other.

Figure 2A:
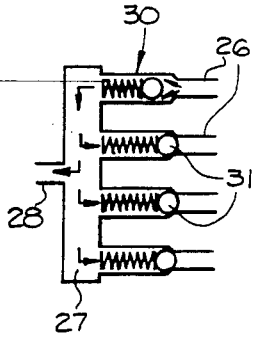
FIG. 2A is a large scale view of a valve means indicated by the arrow 2A in FIG. 2.

In the adjustment of a post 16, the specific maneuver is to actuate the valve means 60 related to that post. This of course relieves the vacuum in that post, but this step points up a great advantage of the valve means 30 (FIG. 2A). Upon opening that valve means 60 (FIGS. 2 and 9), the corresponding check valve 31 (left hand valve FIG. 2A) is opened by the atmospheric pressure in the line 26, while the other check valves 31 remain closed, By this means, the vacuum is maintained in the other three posts. This vacuum persists in normal circumstances for 6–7 hours. Thus adjustments are made very easily to individual posts, to provide perfect spacing between the various posts.

This advantage of the valve means 30 is realized also in a case where a post is not perfectly seated, as by having an article, e.g. a piece of cloth, accidently positioned under the past and preventing a perfect seal, and it is desired to remove it.

The securement of the device to the table top is so great and immense, that the device can be used in any of a wide variety of instances, and as indicated above is not limited to support of an objective as in a surgery operation.

I claim:

1. A support for a patient for spinal surgery, adapted to be supported on a table, comprising, a plurality of post units on the table and having top end elements for engagement by the patient for supporting the patient, the post units being free of mechanical or positive connection with the table and movable thereon in all directions along its surface, the post units having predetermined constructions operable in conjunction with the table top for forming vacuum chambers between the post units and the table top, and means for connecting the vacuum chambers selectively, individually, and simultaneously with a vacuum source.

2. A support according to claim 1 wherein, each post unit includes a base, the base includes a circular outer groove in its under surface and a gasket in the outer groove and extending below the under surface engageable with the table surface and forming said vacuum chamber surrounded by the gasket, the means for connecting the vacuum chamber with a vacuum source includes a passage through the base leading from the vacuum chamber to the exterior, and valve means in the passage.

3. A support according to claim 2 wherein, the under surface of the base is flat, and the vacuum chamber has a depth equal to the extent the gasket extends below the under surface.

4. A support according to claim 2 wherein, the valve means includes a bore in the base forming a portion of said passage, a valve stem in the bore and having a passage communicating with the bore and capable of being connected with the vacuum source, the valve stem being slidable axially between opposite positions and operable in its opposite positions for establishing communication between the bore and the vacuum source, and the exterior, respectively.

5. A support according to claim 4 wherein, the base has a) a vacuum port communicating between the bore and the vacuum chamber, and b) a vent port communicating between the bore and the exterior, and the valve stem is operable for connecting the vacuum port with the vacuum source or with the vent port, respectively.

6. A support according to claim 5 wherein, the vacuum port and the vent port extend radially relative to the bore, the valve stem includes a hose nipple at the outer end exposed outwardly of the base, and has a passage therein extending axially of the valve stem and opening through the outer end of the valve stem, the hose nipple being adapted for connecting with a hose leading from the vacuum source.

7. A support according to claim 6 wherein, the base has a circular inner groove in its under surface inwardly of the gasket, and communicating with the vacuum port.

8. A support according to claim 4 wherein, the bore and valve stem have a projection and recess, respectively, interengaging and thereby limiting the sliding movements of the valve stem in the bore.

9. A support according to claim 8 wherein, the projection in the bore is formed by a screw positioned in the body of the bore and extending through the bore tangent to a base circle concentric with the bore and offset from the axis of the bore.

10. A support according to claim 5 wherein, the valve stem has a reduced diameter portion forming an groove communicating between the vacuum port and the vent port.

11. A support according to claim 6 wherein, the valve stem has a reduced diameter portion forming a groove communicating between the passage in the valve stem and the vacuum port.

12. A support according to claim 4 wherein, the valve stem has a pull knob disposed exteriorly of the base for manual grasping.

13. A support according to claim 4 and including, means for connecting the vacuum chamber with the vacuum source which includes a flexible hose connected with the hose nipple and the vacuum source.

14. A support according to claim 1 in combination with, a table top member capable of supporting the post units and being portable, with the post units, to provide a self-contained kit that can be placed on another supporting surface, and the table member providing a smooth surface for forming effective vacuum chambers with the post units, and thereby enabling effective positioning of the post units notwithstanding the absence of a smooth supporting surface at the setting of a surgery operation.

15. A support according to claim 2 and including, a manifold, said valve means is a sliding valve.

a vacuum line connected between each said sliding valve and the manifold, and a check valve in each said vacuum line between the sliding valve and the manifold.

* * * * *

UNITED STATES PATENT AND TRADEMARK OFFICE

CERTIFICATE OF CORRECTION

PATENT NO. : 5,163,193

DATED : November 17, 1992

INVENTOR(S) : Henry B. Whitmore

Figure 10:
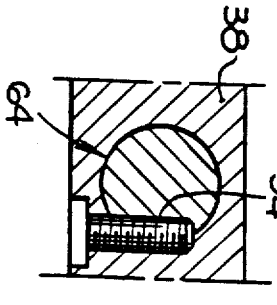
FIG. 10 is a view taken at line 10—10 of FIG. 6.

It is certified that error appears in the above-indentified patent and that said Letters Patent is hereby corrected as shown below:

Figures 9 and 10 have been deleted to be replaced with figures 9 and 10 as shown on the attached sheets.

Signed and Sealed this

Third Day of May, 1994

Bruce Lehman

*Attest:*

BRUCE LEHMAN

*Attesting Officer*

*Commissioner of Patents and Trademarks*